United States Patent [19]

Schwarz et al.

[11] Patent Number: 4,927,559

[45] Date of Patent: May 22, 1990

[54] LOW PERBORATE TO PRECURSOR RATIO BLEACH SYSTEMS

[75] Inventors: Joshua Schwarz, Brooklyn, N.Y.; Christine Accardi, Lodi

[73] Assignee: Lever Brothers Company, New York, N.Y.

[21] Appl. No.: 181,288

[22] Filed: Apr. 14, 1988

[51] Int. Cl.[5] ..... D06L 3/02; C11D 3/39

[52] U.S. Cl. ..... 252/186.39; 252/186.38; 252/186.41; 252/186.21; 252/186.23; 252/186.43; 8/111

[58] Field of Search ..... 252/186.38, 186.39, 252/186.41, 186.21, 186.23, 186.42; 8/111

[56] References Cited

U.S. PATENT DOCUMENTS

| | | | |
|---|---|---|---|
| 2,955,905 | 10/1960 | Davies et al. | 8/111 |
| 4,412,934 | 11/1983 | Chung et al. | 252/186.38 |
| 4,536,314 | 8/1985 | Hardy et al. | 252/102 |
| 4,671,891 | 6/1987 | Hartman | 252/186.42 |
| 4,678,594 | 7/1987 | Parfomak et al. | 252/186.31 |
| 4,735,740 | 4/1988 | Zielske | 252/186.38 X |
| 4,769,173 | 9/1988 | Cornelissen et al. | 252/186.1 X |

FOREIGN PATENT DOCUMENTS

| | | |
|---|---|---|
| 163331 | 12/1985 | European Pat. Off. . |
| 864798 | 4/1961 | United Kingdom . |

*Primary Examiner*—Stephen J. Lechert, Jr.
*Assistant Examiner*—Virginia B. Caress
*Attorney, Agent, or Firm*—Milton L. Honig, Esq.

[57] ABSTRACT

A bleaching composition is disclosed comprising a peroxygen bleaching compound, capable of yielding hydrogen peroxide in an aqueous media, and one or more bleach precursors wherein the peroxygen bleaching compound and precursor are present in a molar ratio that ranges from 0.1 to 2. It is also important that bleaching occur in an aqueous media held at a pH from 8.5 to 9.4. A combination of sodium perborate and sodium benzoyloxybenzene sulfonate is the preferred bleaching composition.

6 Claims, No Drawings

LOW PERBORATE TO PRECURSOR RATIO BLEACH SYSTEMS

BACKGROUND OF THE INVENTION

1. Field of the Invention

The invention relates to improved bleaching compositions and methods for removing hydrophobic stains from fabrics.

2. The Prior Art

Peroxygen bleaches are well known for their commercial usefulness in facilitating stain and/or soil removal from fabrics. Hydrogen peroxide is the most common peroxygen bleach. Although very effective on a variety of stains, hydrogen peroxide requires relatively high activation temperatures and long wash times, e.g. greater than 60° C. for more than 30 minutes. A continuing trend toward lower wash temperatures has presented a need for peroxygen bleaches with efficacy at temperatures of 40° C. and less.

One class of peroxygen bleaches that are particularly effective are organic peracids chemically depicted as $RCO_3H$. The structure of R greatly affects reactivity, solubility and surface activity of a given peracid. Hence, the bleaching efficacy of peracids on stained laundry articles varies greatly depending, through R, on the peracid's relative hydrophobicity or hydrophilicity. For instance, alkyl peracids with chain length greater than about 7 carbon atoms are effective on hydrophobic as well as hydrophilic stains. On the other hand, alkyl peracids with shorter chain length are only effective on hydrophilic stains. Aromatic peracids such as perbenzoic acid are intermediate, i.e. they bleach hydrophobic stains but to a lesser extent than the alkyl peracids. As a result of their potent reactivity, it is difficult to stabilize many peracids so as to directly formulate them with a detergent powder or even as a separate bleach additive product. However, the peracid bleach benefit can be delivered by incorporating into the cleaning powder a two component bleach system, which upon dissolution in the wash liquor react to generate the aforementioned peracid. These systems consist of a source of hydrogen peroxide, such as sodium perborate, and a peracid bleach precursor or activator. Common precursors are found in the class defined by substituted and unsubstituted carboxylic acid esters having a water soluble leaving group.

U.S. Pat. No. 2,955,905 (Davies et al.) is one of the earlier patents in the field revealing this technology. Davies et al. discloses several classes of esters including the commercially available benzoyl ester of sodium phenol sulfonate. Therein, it is suggested that the proportion of ester to per-salt may range in the ratio of ¼ to 2 molecules ester per 1 atom of available oxygen and having present an alkaline material to given an initial pH of between 9 and 11 in the aqueous bleaching solution.

Another early patent of interest is GB No. 864,798 (Hampson et al.) which under the same pH and persalt to reactive ester molar proportions improved upon Davies et al. by recognizing enhanced storage stability with use of acylated phenol esters such as p-acetoxybenzene sulfonate.

U.S. Pat. No. 4,412,934 (Chung et al.) urges the ratio of peroxide source to precursors be at least 1.5 and preferably greater than about 3, to realize maximum conversion of precursor into the reactive peracid. Therein is taught that hydrogen peroxide to precursor ratios of 1 or less results in a lowering of bleaching performance. Below a molar ratio of 1.5, there was found to be a competing chemical reaction diminishing the amount of percarboxylic acid in favor of diacyl peroxides said to perform quite poorly. A preferred pH range was also found to lie between 9 and 10.

The concept that excess hydrogen peroxide over precursor in molar amounts greater than 1.5:1 must be present has become an established principle found in a wave of subsequent patents. These patents include U.S. Pat. No. 4,536,314 (Hardy et al.) and EP No. 0 163 331 (Burns et al.).

U.S. Pat. No. 4,671,891 (Hartman) instructs on compositions that can bleach a wide variety of different types of stains. To obtain removal of both tea and tomato stains, it was found necessary to utilize a halogenated peroxybenzoic acid and a carbonyl carbon atom containing activator which together form diacyl peroxides. The molar ratio of peroxycarboxylic acid to bleach activator covers a range from about 10 to 0.05. These compositions were also said to be highly pH dependent broadly ranging from 6 to 12 but optimally between 8.0 and about 10.

With the excèption of the Hartman patent, most of the known art focusing on precursor and sodium perborate achieves bleaching of only certain types of stains. Most often, the foregoing systems are able to cope with hydrophilic stains, such as tea, but are quite poor at eliminating hydrophobic stains such as generated from tomato sauce. The approach in U.S. Pat. No. 4,671,891 reports a more broad based stain removal but accomplishes this at high cost since it involves use of expensive peroxy carboxylic acids in addition to expensive activators.

Consequently, it is an object of the present invention to provide a bleaching composition that is effective at removing a wide range of stains including those of the hydrophobic and hydrophilic variety.

Another object of the present invention is to accomplish removal of a wide range of stains with as simple and economical a system as possible.

These and further objects of the invention are more fully illustrated by reference to the detailed discussion and examples that follow.

SUMMARY OF THE INVENTION

A bleaching composition to be added to an aqueous medium is provided comprising:

(i) a peroxygen bleaching compound capable of yielding hydrogen peroxide in said aqueous media; and (ii) one or more bleach precursors having the general formula:

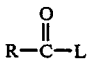

(I)

wherein R is an aromatic or substituted aromatic radical with a total of 6 to about 18 carbon atoms, L is a leaving group, wherein the conjugate acid of the anion formed on L has a $pK_a$ in the range of from about 4 to about 13; and L is selected from the group consisting of:

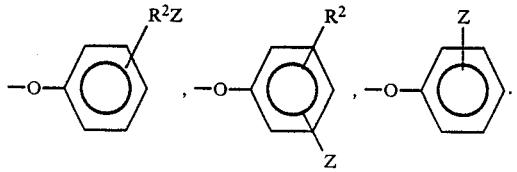

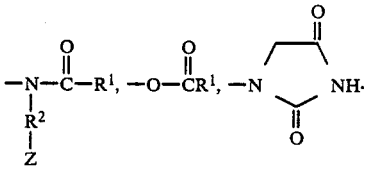

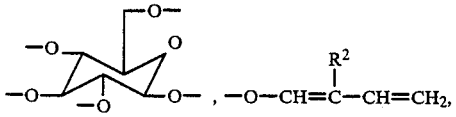

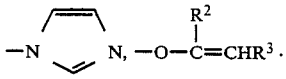

and mixtures thereof; wherein $R^1$ is an alkyl group containing from 5 to about 17 carbon atoms and wherein $R^2$ is an alkyl chain containing from about 1 to about 8 carbon atoms, $R^3$ is H or $R^2$, and Z is H or a solubilizing group; and wherein the peroxygen bleaching compound relative to the precursor is present in a molar ratio that ranges from 0.1 to 2, and the aqueous medium has a pH ranging from 8.5 to 9.4.

DETAILED DESCRIPTION OF THE INVENTION

This invention describes the surprising discovery that for some precursor systems, lowering the molar ratio of peroxygen bleaching compound to precursor in a range between about 0.1 and 2, especially between 0.1 and 1, leads to a dramatic improvement in bleaching of oily, hydrophobic stains. On the other hand, there still is maintained an adequate hydrophilic stain removal effect. For these same systems, increasing the peroxygen bleaching compound to precursor ratio to greater than 2:1 results in a dramatic loss in bleaching of the oily, hydrophobic stains. Here, only the hydrophilic bleaching efficacy is maintained. Thus, now it has been found that a wide range of stains can be removed by adjusting the molar ratio of reactants. Another advantage of the foregoing system is improved economics since much less expensive peroxide is required. A further advantage with these systems is that the normally pungent malodor characteristic of peracid generating precursor systems has been considerably diminished.

Additionally, pH has been found to be an important aspect improving bleach performance of compositions within the present invention. The pH must fall between 8.5 and 9.4, preferably between 8.5 and 9.0, optimally about 8.6.

A further aspect of this invention is the nature of the precursor utilized. Mixtures of precursors may be utilized but it is essential that at least one of these be an aromatic or substituted aromatic ester, as opposed to an alkyl variety, and having the formula:

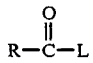

(I)

wherein R is an aromatic or substituted aromatic radical with a total of 6 to about 18 carbon atoms, L is a leaving group, wherein the conjugate acid of he anion formed on L has a $pK_a$ in the range of from about 4 to about 13; and L is selected from the group consisting of:

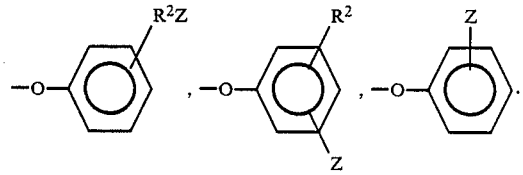

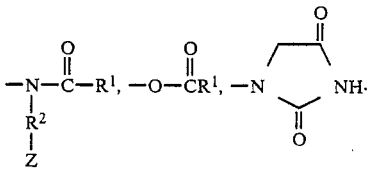

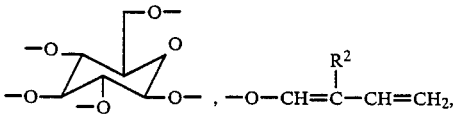

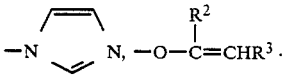

and mixtures thereof; wherein $R^1$ is an alkyl group containing from 5 to about 17 carbon atoms and wherein $R^2$ is an alkyl chain containing from 1 to about 8 carbon atoms, $R^3$ is H or $R^2$, and Z is H or a solubilizing group. When Z is a solubilizing group, the group may be selected from $—SO^-{}_3M^+$, $—COO^-M^+$, $—OSO_3{}^-M^+$, $—N^+(R^3)_3X^-$, $—NO_2$, —OH, and $O\leftarrow N(R^2)_2$ and mixtures thereof; wherein $M^+$ is a cation which provides solubility to the precursor, and $X^-$ is an anion which provides solubility to the precursor.

Illustrative of substituted aromatic radicals are benzene rings substituted with such groups such as $C_1$–$C_9$ alkyl, phenyl, halogen, hydroxyl, $C_1$–$C_6$ alkoxy, $C_1$–$C_6$ acyloxy, carboxy, quaternary ammonium, benzyl, substituted benzyl and mixtures of these groups. Especially preferred are the $C_1$–$C_6$ alkyl benzene and phenyl derivatives of formula I where the leaving group L is a p-phenolsulfonyl group. Most preferred is sodium benzoyloxybenzene sulfonate, herein known as SBOBS.

The foregoing aromatic ester precursors may be combined with a second alkyl type ester precursor whose structure is that of formula I, except that R must be selected from the group consisting of $C_1$–$C_{18}$ carbon atoms containing linear or branched alkyl, alkylene, cyclic alkyl or alkylene, aromatic heterocyclic, and mixed groups thereof.

When both the aromatic and non-aromatic ester precursors are present, the mixture will comprise by mole ratio, respectively, from 10:1 to 1:10, preferably from 2:1 to 1:2, optimally about 1:1.

Hydrogen peroxide sources are well known in the art. They include the alkali metal peroxides, organic peroxide bleaching compounds such as urea peroxide, and inorganic persalt bleaching compounds, such as the alkali metal perborates, percarbonates, perphosphates and persulfates. Mixtures of two or more such compounds may also be suitable. Particularly preferred are sodium perborate tetrahydrate and, especially, sodium perborate monohydrate. Sodium perborate monohydrate is preferred because it has excellent storage stability while also dissolving very quickly in aqueous bleaching solutions. Rapid dissolution is believed to permit formation of higher levels of percarboxylic acid which would enhance surface bleaching performance.

A detergent formulation containing a bleach system consisting of an active oxygen releasing material and a precursor will usually also contain surface-active materials, detergency builders and other known ingredients of such formulations.

The surface-active material may be naturally derived, such as soap, or a synthetic material selected from anionic, nonionic, amphoteric, zwitterionic, cationic actives and mixtures thereof. Many suitable actives are commercially available and are fully described in the literature, for example in "Surface Active Agents and Detergents", Volumes I and II, by Schwartz, Perry and Berch. The total level of the surface-active material may range up to 50% by weight, preferably being from about 1% to 40% by weight of the composition, most preferably 4 to 25%.

Synthetic anionic surface-actives are usually water-soluble alkali metal salts of organic sulphates and sulphonates having alkyl radicals containing from about 8 to about 22 carbon atoms, the term alkyl being used to include the alkyl portion of higher aryl radicals.

Examples of suitable synthetic anionic detergent compounds are sodium and ammonium alkyl sulphates, especially those obtained by sulphating higher ($C_8$–$C_{18}$) alcohols produced for example from tallow or coconut oil; sodium and ammonium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty acid monoglyceride sulphates and sulphonates; sodium and ammonium salts of sulphuric acid esters of higher ($C_9$–$C_{18}$) fatty alcohol-alkylene oxide, particularly ethylene oxide, reaction products; the reaction products of fatty acids such as coconut fatty acids esterified with isethionic acid and neutralized with sodium hydroxide; sodium and ammonium salts of fatty acid amides of methyl taurine; alkane monosulphonates such as those derived by reacting alpha-olefins ($C_8$–$C_{20}$) with sodium bisulphite and those derived by reacting paraffins with $SO_2$ and $Cl_2$ and then hydrolyzing with a base to produce a random sulphonate; sodium and ammonium $C_7$–$C_{12}$ dialkyl sulfosuccinates; and olefin sulphonates, which term is used to describe the material made by reacting olefins, particularly $C_{10}$–$C_{20}$ alpha-olefins, with $SO_3$ and then neutralizing and hydrolyzing the reaction product. The preferred anionic detergent compounds are sodium ($C_{11}$–$C_{15}$) alkylbenzene sulphonates, sodium ($C_{16}$–$C_{18}$) alkyl sulphates and sodium ($C_{16}$–$C_{18}$) alkyl ether sulphates.

Examples of suitable nonionic surface-active compounds which may be used, preferably together with the anionic surfaceactive compounds, include in particular the reaction products of alkylene oxides, usually ethylene oxide, with alkyl ($C_6$–$C_{22}$) phenols, generally 5–25 EO, i.e. 5–25 units of ethylene oxides per molecule; the condensation products of aliphatic ($C_8$–$C_{18}$) primary or secondary linear or branched alcohols with ethylene oxide, generally 6–30 EO, and products made by condensation of ethylene oxide with the reaction products of propylene oxide and ethylene diamine. Other so-called nonionic surface-actives include alkyl polyglycosides, long chain tertiary amine oxides, long chain tertiary phosphine oxides and dialkyl sulphoxides.

Amphoteric or zwitterionic surface-active compounds can also be used in the compositions of the invention but this is not normally desired owing to their relatively high cost. If any amphoteric or zwitterionic detergent compounds are used, it is generally in small amounts in compositions based on the much more commonly used synthetic anionic and nonionic actives.

Soaps may also be incorporated into the compositions of the invention, preferably at a level of less than 30% by weight. They are particularly useful at low levels in binary (soap/anionic) or ternary mixtures together with nonionic or mixed synthetic anionic and nonionic compounds. Soaps which are used are preferably the sodium, or less desirably potassium, salts of saturated or unsaturated $C_{10}$–$C_{24}$ fatty acids or mixtures thereof. The amount of such soaps can be varied between about 0.5% and about 25% by weight, with lower amounts of about 0.5% to about 5% being generally sufficient for lather control. Amounts of soap between about 2% and about 20%, especially between about 5% and about 15%, are used to give a beneficial effect on detergency. This is particularly valuable in compositions used in hard water where the soap acts as a supplementary builder.

The detergent compositions of the invention will normally also contain a detergency builder. Builder materials may be selected from (1) calcium sequestrant materials, (2) precipitating materials, (3) calcium ion-exchange materials and (4) mixtures thereof.

Examples of calcium sequestrant builder materials include alkali metal polyphosphates, such as sodium tripolyphosphate; nitrilotriacetic acid and its water-soluble salts; the alkali metal salts of carboxymethyloxy succinic acid, ethylene diamine tetraacetic acid, oxydisuccinic acid, mellitic acid, benzene polycarboxylic acids, citric acid; and polyacetalcarboxylates as disclosed in U.S. Pat. Nos. 4,144,226 and 4,146,495.

Examples of precipitating builder materials include sodium orthophosphate, sodium carbonate and long-chained fatty acid soaps.

Examples of calcium ion-exchange builder materials include the various types of water insoluble crystalline or amorphous aluminosilicates, of which zeolites are the best known representatives.

These builder materials may be present at a level of, for example, from 5 to 80% by weight, preferably from 10 to 60% by weight.

When the peroxygen compound and bleach precursor are dispersed in water, a peroxy acid is generated which should deliver from about 0.1 to about 50 ppm active oxygen per liter of water; preferably oxygen delivery should range from 2 to 15 ppm. Surfactant should be present in the wash water from about 0.05 to 1.0 grams per liter, preferably from 0.15 to 0.20 grams per liter. When present, the builder amount will range from about 0.1 to 3.0 grams per liter.

Apart from the components already mentioned, the detergent compositions of the invention can contain any of the conventional additives in the amounts in which such materials are normally employed. Examples of these additives include lather boosters such as alkanolamides, particularly the monoethanolamides derived from palmkernel fatty acids and coconut fatty acids, lather depressants such as alkyl phosphates and silicones, anti-redeposition agents such as sodium carboxymethylcellulose and alkyl or substituted alkylcellulose ethers, other stabilizers such as ethylene diamine tetraacetic acid and the phosphonic acid based chelants (e.g. Dequest® type), fabric softening agents, inorganic salts such as sodium sulphate, and, usually present in very small amounts, fluorescent agents, perfumes, enzymes such as proteases, cellulases, lipases and amylases, germicides and colorants.

The bleach precursors and their peroxycarboxylic acid derivatives described herein can be introduced in a variety of product forms including powders, thickened liquids, on sheets or other substrates, in pouches, in tablets or in non-aqueous liquids such as liquid nonionic detergents.

The following examples will more fully illustrate the embodiments of this invention. All parts, percentages and proportions referred to herein and in the appended claims are by weight unless otherwise illustrated.

EXAMPLE 1

The stain bleaching ability of sodium benzoyloxybenzene sulfonate (SBOBS) is herein demonstrated on common stains such as spaghetti sauce and red wine. Typically, cotton test pieces (4 in.×4 in.) stained with the appropriate stain were washed in a Terg-O-Tometer in 1 l. of aqueous solution containing a given level of bleach precursor, hydrogen peroxide, buffer, and surfactant (generally sodium dodecylbenzenesulfonate).

Washes were carried out at 40° C. for 15 minutes. Stain bleaching was measured reflectometrically using a Colorgard System/05 Reflectometer. Bleaching is indicated by an increase in reflectance, reported as ΔR. In general, a ΔR of one unit is perceivable in a paired comparison while ΔR of two units is perceivable monadically. In reporting the reflectance change, the change in reflectance caused by general detergency and bleaching by the excess hydrogen peroxide has been accounted for. Thus ΔR can actually be expressed as:

| | | |
|---|---|---|
| ΔR | = | (Reflectance of stained fabric washed with precursor/$H_2O_2$ and detergent - Reflectance of stained fabric before washing) - (Reflectance of stained fabric washed with $H_2O_2$ and detergent alone - Reflectance of stained fabric before washing). |

In the case of spaghetti stain, bleaching performance is stated as "Δb" where the quantity "Δb" is the change in the b-axis of the Hunter color scale. The spaghetti stain is initially yellow and loses color with bleaching and thus bleaching produces a negative change in b. Since peroxide-only controls were also carried out with the spaghetti sauce stains, percarboxylic acid bleaching is actually reported as "Δb".

Ragu® spaghetti sauce, a used in the context of this invention, is actually an extract of the stain rather than simply the sauce smeared onto a cloth. Oil soluble components of Ragu®, such as the orange red pigment lycopene and other carotenes, are extracted by centrifuging a mixture of toluene (5 ml) and sauce (35 gms) for 15 minutes. At the end of that period a clear deeply red-orange supernatant liquid separates from the pulpy mass. This liquid is the Ragu® spaghetti sauce stain used in the experiments of this invention.

Tables I and II detail he results of perborate/SBOBS as relative molar ratios in the bleaching of Ragu® spaghetti sauce and Crisco® blue (anthraquinone dye dissolved in Crisco® oil).

TABLE I

The Effect of Varying Perborate and SBOBS Levels on Ragu® Bleaching

| Molar Ratio Perborate:SBOBS | [SBOBS] = 10 ppm Δb | [SBOBS] = 15 ppm Δb |
|---|---|---|
| 0.25:1.00 | 10.62 | 18.87 |
| 0.50:1.00 | 10.37 | 20.27 |
| 0.75:1.00 | 8.90 | 17.67 |
| 1.00:1.00 | 6.57 | 11.40 |
| 1.50:1.00 | 1.95 | 2.80 |
| 2.00:1.00 | 0.97 | 3.04 |
| 5.00:1.00 | 0.92 | 0.92 |

TABLE II

The Effect of Varying Perborate and SBOBS Levels on Crisco® Blue Bleaching

| Molar Ratio Perborate:SBOBS | [SBOBS] = 10 ppm Δb |
|---|---|
| 0.25:1.00 | 11.95 |
| 0.50:1.00 | 11.60 |
| 0.75:1.00 | 11.80 |
| 1.00:1.00 | 7.98 |
| 1.25:1.00 | 6.40 |
| 1.50:1.00 | 3.80 |

Table I demonstrates the dramatic increase in bleaching of Ragu® spaghetti sauce stains when the perborate/SBOBS molar ratio goes below 1.00. Under a molar ratio of 1.50, the bleaching of the Ragu® model hydrophobic stain decreased almost ten-fold relative to the 0.50 ratio.

Table II demonstrates a similar dramatic increase in bleaching with respect to Crisco® oily stain when the molar ratio perborate/SBOBS is kept at or below 1.00.

Note, however, that as either the total level of precursor plus perborate or temperature is reduced, the ratio at which optimal performance occurs shifts to a somewhat higher value. For instance, at 5 ppm SBOBS the optimum performance lies within the ratio of about 1 to 2.

TABLE III

The Effect of Varying Perborate and SBOBS Levels on Wine and Ragu® Stains Under Similar Conditions*

| Molar Ratio Perborate:SBOBS | Ragu® (Δb) | EMPA (ΔR) |
|---|---|---|
| 0.50:1.00 | 23.83 | 30.36 |
| 0.67:1.00 | 21.95 | 31.55 |
| 1.00:1.00 | 15.55 | 32.11 |
| 6.00:1.00 | 1.50 | 35.74 |

*pH 9, 15 ppm active oxygen, 40° C.

Table III details the effect under identical washing conditions of various perborate/SBOBS molar ratios levels to bleach both hydrophilic (wine-EMPA) and hydrophobic (Ragu®) type stains. The data shows that at a molar ratio of 1.00 or less both type of stains can be removed. Higher ratio combinations are only effective against the hydrophilic stain.

EXAMPLE 2

Experiments are herein reported which evaluates the performance of a well-known commercial alkyl type precursor, sodium nonanoyloxybenzene sulfonate (SNOBS), relative to that of the aromatic type, sodium benzoyloxybenzene sulfonate (SBOBS) of the present invention. Bleach tests were carried out in accordance with the method outlined in Example 1. Table IV details the results.

TABLE IV

| Bleaching With SBOBS and SNOBS on Ragu ® Stained Cloth | | |
|---|---|---|
| Molar Ratio | Δb | |
| Perborate:Precursor* | SBOBS | SNOBS |
| 0.0:1.0 | 0.00 | 0.00 |
| 0.5:1.0 | 20.27 | 3.88 |
| 1.0:1.0 | 10.50 | 4.43 |
| 2.0:1.0 | 1.80 | 5.13 |
| 6.0:1.0 | 0.05 | 9.11 |

*Precursor concentration = 15 ppm

From results of Table IV, it is seen that there is an apparently linear increase in the bleaching effect of SNOBS as the molar ratio goes from low perborate (0.5) to high perborate (6.0). By contrast, SBOBS is most effective at low perborate (2.0 or less) ratio and its efficiency appears to be greater than that of SNOBS within its optimum ratio range

EXAMPLE 3

A further feature of the compositions presented by this invention is that their performance is pH sensitive. Table V details results of experiments tracking the pH effect in a perborate/SBOBS system of relative ratio 0.75:1

TABLE V

| Effect of pH on SBOBS Bleaching | | |
|---|---|---|
| pH | Ragu ® (Δb) | Crisco ® Blue (ΔR) |
| | A. 15 ppm Active Oxygen | |
| 8.6 | 18.70 | 12.20 |
| 9.0 | 13.50 | 10.00 |
| 9.4 | 9.10 | 8.50 |
| 9.8 | 5.80 | 5.50 |
| | B. 10 ppm Active Oxygen | |
| 8.60 | 11.90 | 9.90 |
| 9.00 | 10.20 | 8.20 |
| 9.40 | 5.80 | 4.80 |
| 9.80 | 1.90 | 2.60 |

From Table V, it is evident beyond pH 9.4 there is a significant drop in the bleaching efficiency of low perborate/SBOBS systems.

The foregoing descriptions and Examples illustrate selected embodiments of the present invention and in light thereof various modifications will b suggested to one skilled in the art, all of which are within the spirit an purview of this invention.

What is claimed is:

1. A bleaching composition to be added to an aqueous medium comprising:

(i) a peroxygen bleaching compound capable of yielding hydrogen peroxide in said aqueous media; and (ii) one or more bleach precursors having the general formula:

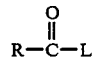

(I)

wherein R is an aromatic or substituted aromatic radical with a total of 6 to about 18 carbon atoms, L is a leaving group, wherein a conjugate acid of an anion formed on L has a $pK_a$ in the range of from about 4 to about 13; and L is selected from the group consisting of:

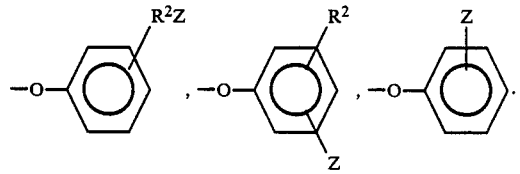

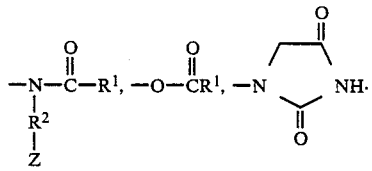

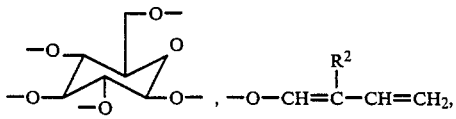

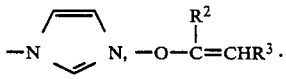

and mixtures thereof; wherein $R^1$ is an alkyl group containing from 5 to about 17 carbon atoms and wherein $R^2$ is an alkyl chain containing from about 1 to about 8 carbon atoms, $R^3$ is H or $R^2$, and Z is H or a solubilizing group; and wherein the peroxygen bleaching compound relative to the precursor is present in a molar ratio that ranges from 0.1 to 1, and the pH of the aqueous media ranges from 8.5 to 9.4.

2. A composition according to claim 1 wherein the precursor is sodium benzoyloxybenzene sulfonate.

3. A composition according to claim 2 wherein the peroxygen bleaching compound is sodium perborate.

4. A composition according to claim 1 wherein said ratio ranges from 0.25 to 1.0.

5. A method of removing hydrophobic stains from fabrics comprising contacting the hydrophobic stained fabric with a composition according to claim 1 in an aqueous media.

6. A method according to claim 5 wherein said peroxygen bleaching compound is sodium perborate and said bleach precursor is sodium benzoyloxybenzene sulfonate.

* * * * *